US005349412A

United States Patent [19]

Miyasaka

[11] Patent Number: 5,349,412

[45] Date of Patent: Sep. 20, 1994

[54] METHOD AND APPARATUS FOR PROCESSING PHOTOSENSITIVE MATERIAL

[75] Inventor: Eiji Miyasaka, Hokone, Japan

[73] Assignee: Dainippon Screen Mfg. Co., Ltd., Japan

[21] Appl. No.: 799,394

[22] Filed: Nov. 27, 1991

[30] Foreign Application Priority Data

Nov. 27, 1990 [JP] Japan ..... 2-327329

[51] Int. Cl.[5] ..... G03D 13/00; G03D 3/02

[52] U.S. Cl. ..... 354/299; 354/317; 354/324

[58] Field of Search ..... 354/299, 317–324

[56] References Cited

U.S. PATENT DOCUMENTS

| | | | |
|---|---|---|---|
| 3,280,716 | 10/1966 | Gall | 354/323 X |
| 4,135,803 | 1/1979 | Van Houwelingen | 354/299 |
| 4,141,314 | 2/1979 | Newson | 354/318 X |
| 4,737,810 | 4/1988 | Kobayashi et al. | 354/317 X |
| 4,837,131 | 6/1989 | Kobayashi et al. | 354/322 X |

FOREIGN PATENT DOCUMENTS

| | | | |
|---|---|---|---|
| 2-79836 | 9/1988 | Japan . | |
| 2-79842 | 9/1988 | Japan . | |
| 2-79844 | 9/1988 | Japan . | |
| 02-99945 | 4/1990 | Japan | 354/317 |
| 417333 | 2/1967 | Switzerland | 354/318 |
| 744243 | 2/1956 | United Kingdom | 354/319 |
| 1135412 | 12/1968 | United Kingdom . | |

OTHER PUBLICATIONS

Vol. 14 No. 104 (P-1013) [4047] Feb. 26, 1990, "Coater", Fuji Photo Film Co. Ltd. Abstract.

*Primary Examiner*—D. Rutledge

*Attorney, Agent, or Firm*—Ostrolenk, Faber, Gerb & Soffen

[57] ABSTRACT

The invention provides an apparatus for developing and fixing a silver salt photosensitive material. The apparatus uniformly applies a fixed amount of new or unused processing solution onto the photosensitive material so as to maintain processing quality and reduce a required volume of the processing solution and labor for maintenance.

New or unused developer supplied from a developer nozzle 82 and temporarily stored in a basin 143 is uniformly held in pores on the surface of a developer applying roller 93. While the developer applying roller 93 is rotated, the new developer held in the pores of the roller 93 is applied onto the surface of a photosensitive material PM, which is pressed against the circumference of the roller 93 during conveyance, to develop the photosensitive material PM. The apparatus of the invention develops the photosensitive material with new developer applied to the roller 93 and thereby maintains processing quality even when a large number of photosensitive materials PM are processed. Furthermore, the invention does not require troublesome discharge or replacement of processing solution, which is generally carried out after processing of a certain number, thus saving time and labor. The processing method of the invention also reduces a required volume of processing solution.

13 Claims, 9 Drawing Sheets

METHOD AND APPARATUS FOR PROCESSING PHOTOSENSITIVE MATERIAL

BACKGROUND OF THE INVENTION

1. Field of the Invention

The present invention relates to method and apparatus for developing, fixing, and processing silver salt photosensitive material including printing paper and photosensitive paper and films for direct plate making.

2. Description of the Prior Art

Process cameras are applicable to produce a plate directly from an original for in-plant printing, as offset print and mimeographing. A photosensitive material used for such reproduction generally consists of plural layers of different functions adhering to a water proof base sheet. The laminate includes: a layer for preventing halation; a layer of photosensitive silver salt emulsion; and a hydrophilic layer mainly composed of gelatin with nuclei for physical development such as silver dispersed therein. Irradiation with light changes properties of the emulsion layer. In portions irradiated with light, diffusion of reduced silver from the emulsion layer to the surface layer under the influence of developer is efficiently prevented. On the contrary, in other portions without irradiation, silver halide is complexed and diffused from the emulsion layer to the surface layer. The silver halide diffused onto the surface is physically developed to deposit metallic silver. In subsequent fixation, printing ink is mounted only on lipophilic portions with deposited metallic silver and is not on other portions. A plate for in-plant printing is accordingly prepared.

The photosensitive material reacts with processing solution such as developer at a high rate. A momentary hold of the material in the processing solution or rough surface of the solution may cause unevenness of development or other processes. Still processing solution is hence required to maintain high processing quality. A method proposed to fulfill the requirement is that photosensitive material is soaked in a large volume of processing solution such as developer or fixer stored in a tank. In this case, there is need of large apparatus or equipment for storing a large volume of processing solution.

A photosensitive material soaked in a large volume of processing solution is conveyed slowly so as to keep the surface still, and is taken out of the process tank on completion of processing such as development or fixation.

This method, however, has some drawbacks: a large volume of processing solution stored in the process tank deteriorates with a number of photosensitive materials processed, and alkaline developer in the tank is oxidized with the elapse of time. The changeable properties makes the quality of processing unstable. Frequent replacement of processing solution each after completion of processing of a predetermined number of photosensitive materials is essential to maintain the processing or developing quality. The replacement is, however, time consuming and furthermore changes the processing performance drastically.

This conventional method further requires a relatively long warm-up time for raising the temperature of processing solution to an optimal value. A large capacity of temperature control heater is needed to shorten the warm-up time. It is also difficult to maintain the constant temperature of processing solution in the large volume of tank.

On the other hand, a smaller process tank and thereby a smaller volume of processing solution resuscitate the problem of uneven development or processing. Furthermore, slow transport of photosensitive material through the process tank is required to complete the processing; namely, processing in the smaller tank is time consuming.

SUMMARY OF THE INVENTION

The primary objective of the invention is to reduce a required volume of processing solution while its processing quality is maintained.

The specific objective of the invention is to attain simple maintenance of a processing apparatus and easy temperature control of processing solution so as to improve usability of the processing apparatus.

The above objectives and other related objectives are attained by the following structure of the invention.

In the apparatus for processing a photosensitive material according to the invention, a fixed amount of new or unused processing solution is supplied and temporarily stored between the roller with liquid retentive surface and the member pressed against the circumference of the roller along the width thereof. The new processing solution temporarily stored is uniformly held on the surface of the roller through rotation of the roller. With further rotation of the roller, the processing solution held on the surface of the roller is applied onto the surface of the photosensitive material, which is pressed against the roller during conveyance, to process the photosensitive material.

Direct application of processing solution onto the surface of the photosensitive material makes any process tank of a large volume unnecessary and reduces a necessary volume of processing solution. Processing with new or unused processing solution allows processing quality to be maintained. The apparatus of the invention does not require troublesome discharge or replacement of processing solution, thereby saving time and labor and improving usability thereof.

The apparatus requires temperature control not for a large volume of the process tank but for a small volume of processing solution applied to the photosensitive material, thus simplifying process of temperature control and improving usability thereof.

The photosensitive material processed by the apparatus of the invention is silver salt photosensitive paper and films for reproduction as well as silver salt printing paper.

BRIEF DESCRIPTION OF THE DRAWINGS

The invention may be best understood by referring to the following detailed description of the preferred embodiments and the accompanying drawings, wherein like numerals denote like elements and in which.

DESCRIPTION OF THE PREFERRED EMBODIMENT

Apparatus for processing photosensitive material of the invention is now described based on preferred embodiments thereof.

Figure 1:
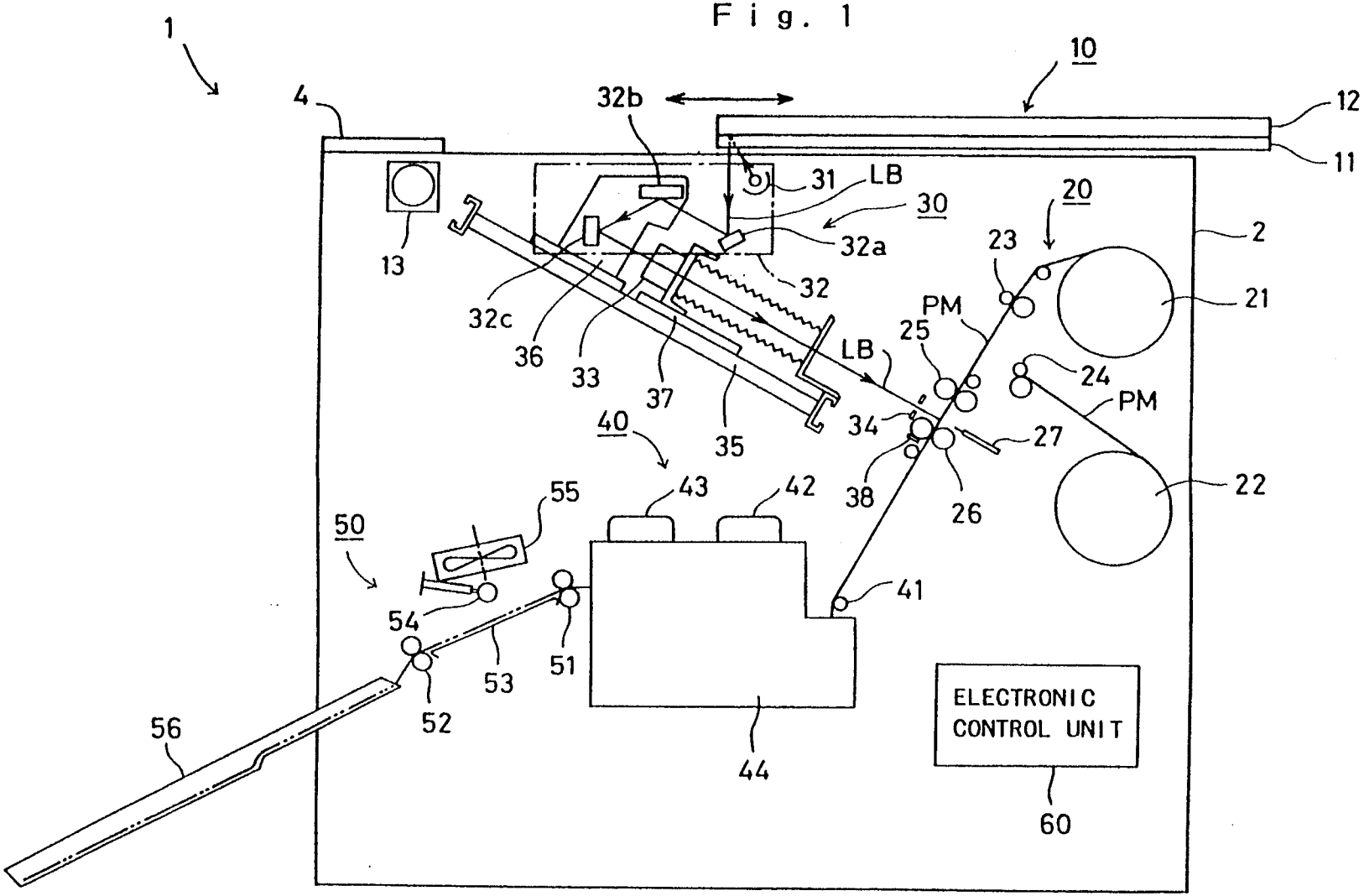
FIG. 1 is a schematic view showing a slit exposure process camera 1 including a processor of a first embodiment.

FIG. 1 is a schematic view showing a slit exposure process camera 1 for reproducing an original to form a plate for in-plant printing.

The slit exposure process camera 1 includes an optical projection system and a processor (described later) disposed in a camera casing 2 as shown in FIG. 1. The camera 1 includes: a console panel mounted on the upper face of the camera casing 2; a holder 10, horizontally movable along the upper face of the camera casing 2, for supporting an original; a photosensitive material transport unit 20 for conveying a sheet of photosensitive material PM to the position of exposure; an optical projection system 30 for irradiating an original held in the holder 10 with light and projecting the light reflected from the original onto the surface of the photosensitive material PM for exposure; a processor 40 for developing and fixing the exposed photosensitive material PM; a dry unit 50 for drying the photosensitive material PM sent from the processor 40; and an electronic control unit 60 for actuating and controlling motors and electromagnets (described later).

On the console panel 4, Various switches including set switches for determining exposure conditions, a power switch, and a start switch are mounted. These switches are operated by an operator. Each switch on the console panel 4 is connected to the electronic control unit 60.

The holder 10 includes a transparent glass base 11 and an openable cover 12. An original is placed with the surface downward in between the base 11 and the cover 12. The holder 10 is driven by a motor 13, disposed in the camera casing 2, via a driving system (not shown in figures) including a sprocket, a chain, and a belt so as to move horizontally to send the original to an exposure light at a uniform speed.

The photosensitive material transport unit 20 includes: a first roll of photosensitive material 21; a second roll of photosensitive material 22; a pair of rollers 23 for feeding the photosensitive material from the first roll 21; a pair of rollers 24 for feeding the photosensitive material from the second roll 22; and two pairs of rollers 25 and 26 used for feeding the photosensitive material both from the first and the second rolls 21 and 22. The photosensitive material transport unit 20 feeds a sheet of the photosensitive material PM from either of the first and the second rolls 21 and 22 as required. In the embodiment, a silver salt photosensitive sheet sold under the trade name SILVER MASTER SLM-RII by Mitsubishi Paper Mills, Ltd. is used; however, it may be any silver salt photosensitive paper for reproduction such as one sold under the trade name of SUPER MASTER SPP by Agfa Gevaert, silver salt films, or high-sensitive PS plates.

The photosensitive material PM is successively fed from the first roll 21 and conveyed through the three pairs of rollers 23, 25, and 26 as seen in FIG. 1. Alternatively, the photosensitive material PM of the second roll 22 is conveyed through the roller pairs 24, 25, and 26.

Conveyance of the photosensitive material PM fed from the first roll 21 or the second roll 22 is synchronized with the horizontal movement of the holder 10. The photosensitive materials of the first roll 21 and the second roll 22 generally have different widths.

The photosensitive material PM thus conveyed is exposed at a position preset between the two pairs of rollers 25 and 26 and cut to a certain size, predetermined with the console panel 4, by a cutting device 27 attached on the rear face side of the photosensitive material PM.

The optical projection system 30 includes: a light source 31 for irradiating the width of the original held in the holder 10; a mirror combination 32 consisting of three mirrors **32*a*, 32*b*, and 32*c* for reflecting light LB reflected from the original; a projecting lens 33 for focusing an image representing the original on the surface of the photosensitive material PM placed at the exposure position; and a slit 34 for adjusting the width of the light LB projected on the surface of the photosensitive material. The projecting lens 33 and the mirrors 32*b* and 32*c* of the mirror combination 32 are fixed to a lens support 37 and a mirror support 36 on a slope base 35, respectively. The projecting magnification of the optical projection system 30 is set to one. The positions of the mirror support 36 and the lens support 37 are adjusted with respect to the slope base 35 on the alignment of the system 30** and then fixed thereto.

Light transmitting from the light source 31 to the original is reflected from the lower face of the original. The reflected light LB is successively reflected from the mirrors of the mirror combination 32, passes through the projecting lens 33 and the slit 34, and is focused on the face of the photosensitive material PM. Namely, a band of image corresponding to the width of the original is focused on the photosensitive face of the conveyed photosensitive material PM. Since the transport of the photosensitive material PM is synchronized with the horizontal movement of the holder 10, exposure of the whole original is accomplished with completion of the horizontal movement of the holder 10. The photosensitive material PM is then cut by the cutting device 27.

At the downstream position of the roller pair 26, plural LEDs 38 are aligned downstream for exposing the photosensitive material PM. A desired portion of the photosensitive material PM is irradiated with part of or the whole LEDs 38. Periphery of the photosensitive material, which is not exposed to the light LB reflected from the original, may be burned out as non-required portion on reduced exposure.

The processor 40 is disposed below the optical projection system 30 for developing and fixing the photosensitive material transferred via a guide roller 41. The processor 40 includes a process unit 44 integrally driven with the rollers by a motor (not shown in figures) and stored in the casing 2. A main developer tank 42 for storing developer and a main fixer tank 43 for storing fixer are detachably attached to the process unit 44. Details of the processor 40 are described later.

The dry unit 50 is disposed downstream the processor 40 along the transport path of the photosensitive material PM. The dry unit 50 includes: two pairs of rollers 51 and 52 for conveying the photosensitive material PM processed by the processor 40; a transport tray 53 mounted in between the roller pairs 51 and 52; a heater 54 and a fan 55 disposed above the transport tray 53 for drying the photosensitive material PM; and an external tray 56 disposed outside the casing 2 for storing the photosensitive material PM thus dried.

The photosensitive material PM exposed is processed for development and fixation by the processor 40, dried with the heater 54, and then fed out to the external tray 56 outside the casing 2. A plate for offset printing is accordingly reproduced and formed from the original.

The processor 40 for developing and fixing the photosensitive material PM is described based on FIGS. 2, 3, 4, and 5.

Figure 2:
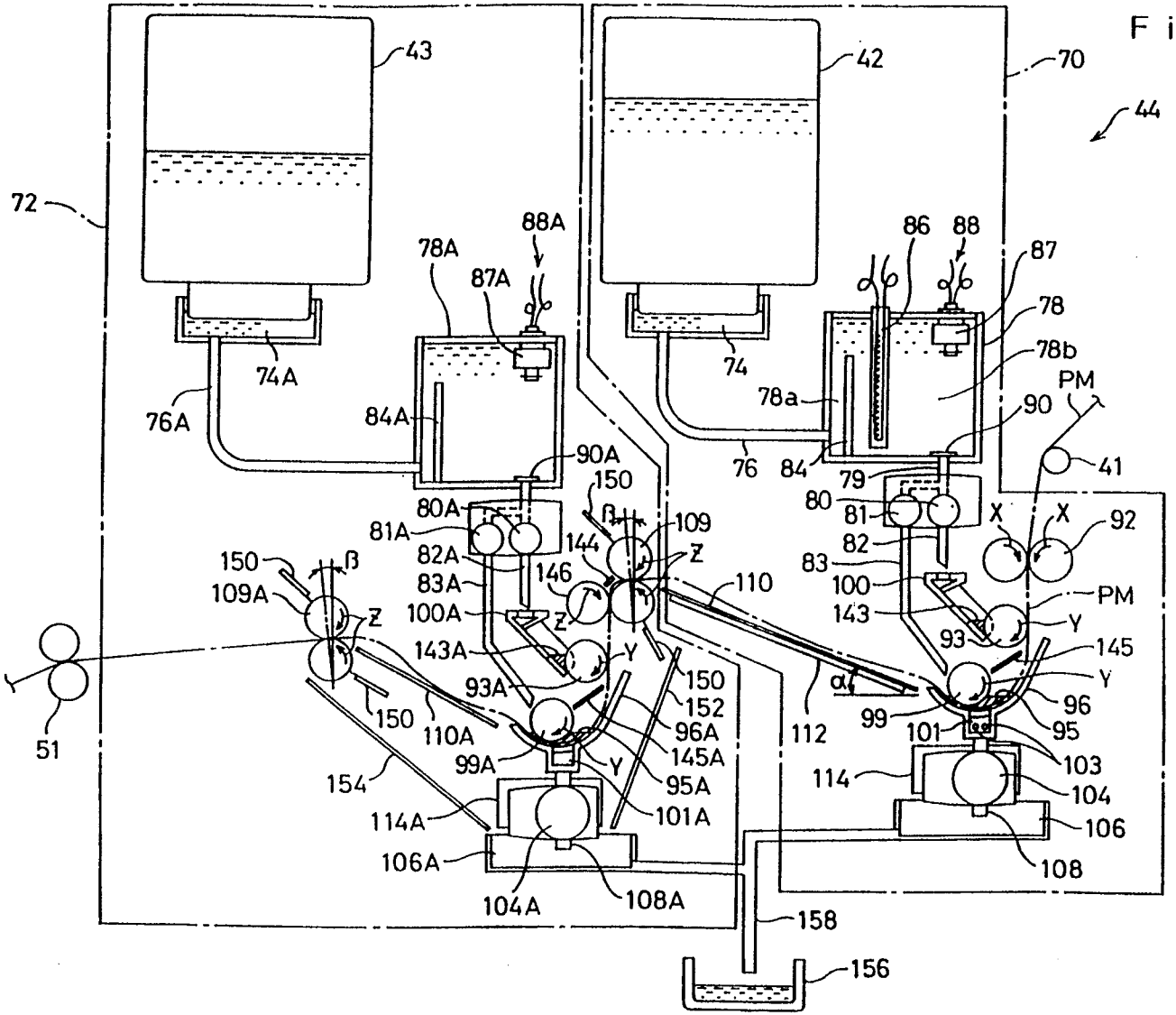
FIG. 2 is a schematic view showing structure of the processor of FIG. 1 embodying the invention.

As seen in FIG. 2, the processor 40 includes: a development unit 70 for developing the photosensitive material PM, exposed and conveyed through the guide roller 41, with developer in the main developer tank 42; and fixation unit 72 for fixing the developed photosensitive material PM with fixer in the main fixer tank 43 and transferring the fixed material PM to the roller pair 51 of the dry unit 50.

Besides the main developer tank 42, the development unit 70 includes: liquid level control cylinder 74 detachably mounted on the main developer tank 42 for receiving developer supplied from the main tank 42 and maintaining the liquid level constant; an developer cistern tank 78 for receiving the developer via the liquid level control cylinder 74 and a conduit 76; electromagnetic valves 80 and 81 for opening and closing exit passes of the developer running from the developer cistern tank 78; and developer nozzles 82 and 83 for making flow of the developer. The developer nozzle 82 has a orifice (see FIG. 5), which controls the amount of developer supplied from the developer nozzle 82 while the electromagnetic valve 80 opens. The amount of supply is determined corresponding to the inner diameter of the orifice and the pressure applied to the orifice with respect to the liquid level in the liquid level control cylinder 74. In the embodiment, the liquid level is maintained constant and flow of the developer is thus kept constant irrespective of the volume of developer in the main developer tank 42.

The developer cistern tank 78 includes an upright panel 84 for separating a reserve chamber **78*b* from a flow chamber 78*a* having the conduit 76. A heater 86 inserted downward and a float sensor 88 are mounted on the upper face of the reserve chamber 78*b*. The float sensor 88 has a float 87 which is vertically movable corresponding to the liquid level, and thereby detects the liquid level of the tank 78. An opening of a passage 79 connected to the bottom of the developer cistern tank 78** has a mesh filter for removing dust or foreign matters from developer which flows out.

Cold developer supplied from the main developer tank 42 first flows into the flow chamber **78*a* via the conduit 76 and then passes over the upright panel 84 to the reserve chamber 78*b*. Developer in the reserve chamber 78*b* is heated with the heater 86 and kept at a predetermined temperature by the electronic control unit 60. The developer thus heated is flown out of the developer nozzles 82 and 83 by opening of the electromagnetic valves 80 and 81**.

Structure and function of a process tank 96 for developing the photosensitive material PM are described hereinafter. A pair of feed rollers 92 rotating in a direction shown by the arrow X of FIG. 5 to feed the photosensitive material PM is disposed below the guide roller 41 for feeding the photosensitive material PM to the development unit 70. A developer applying roller 93 is further disposed below the roller pair 92 to be in contact with the surface of the photosensitive material PM. The developer applying roller 93 rotates in a direction shown by the arrow Y of FIG. 5 for applying the developer on the surface of the material PM.

Figure 4:
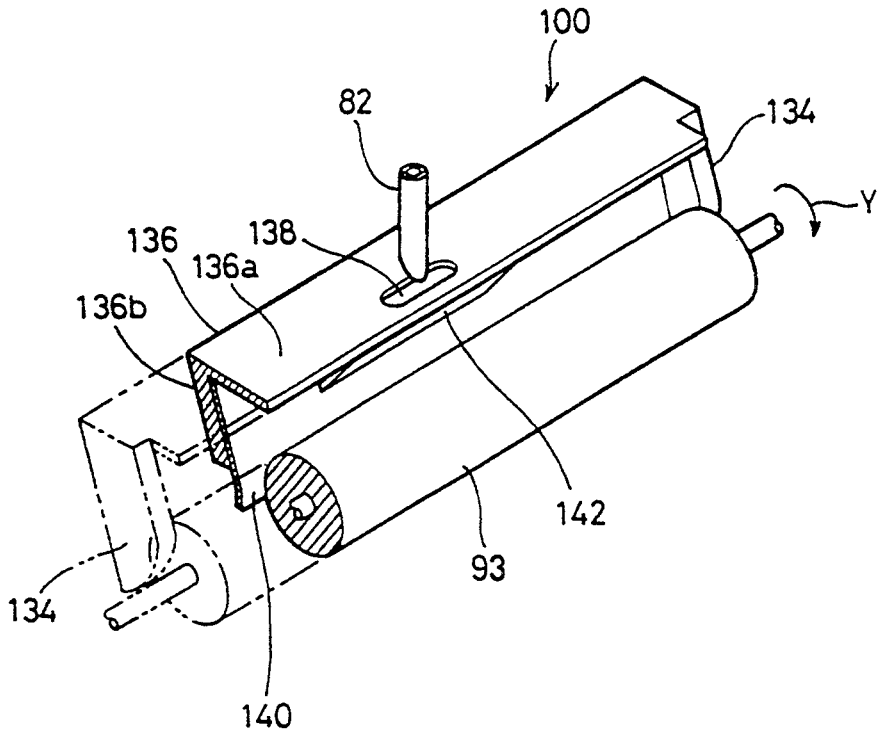
FIG. 4 is a perspective view illustrating a developer applying roller 93 and a temporary reservoir 100.

The surface of the developer supply roller 93 is made of sponge containing a large number of pores separated from one another (separate pores). As seen in FIG. 4, the developer supply roller 93 is provided with a temporary reservoir 100 for temporary storing developer that has fallen downward. Structure of the temporary reservoir 100 is described later.

Figure 3:
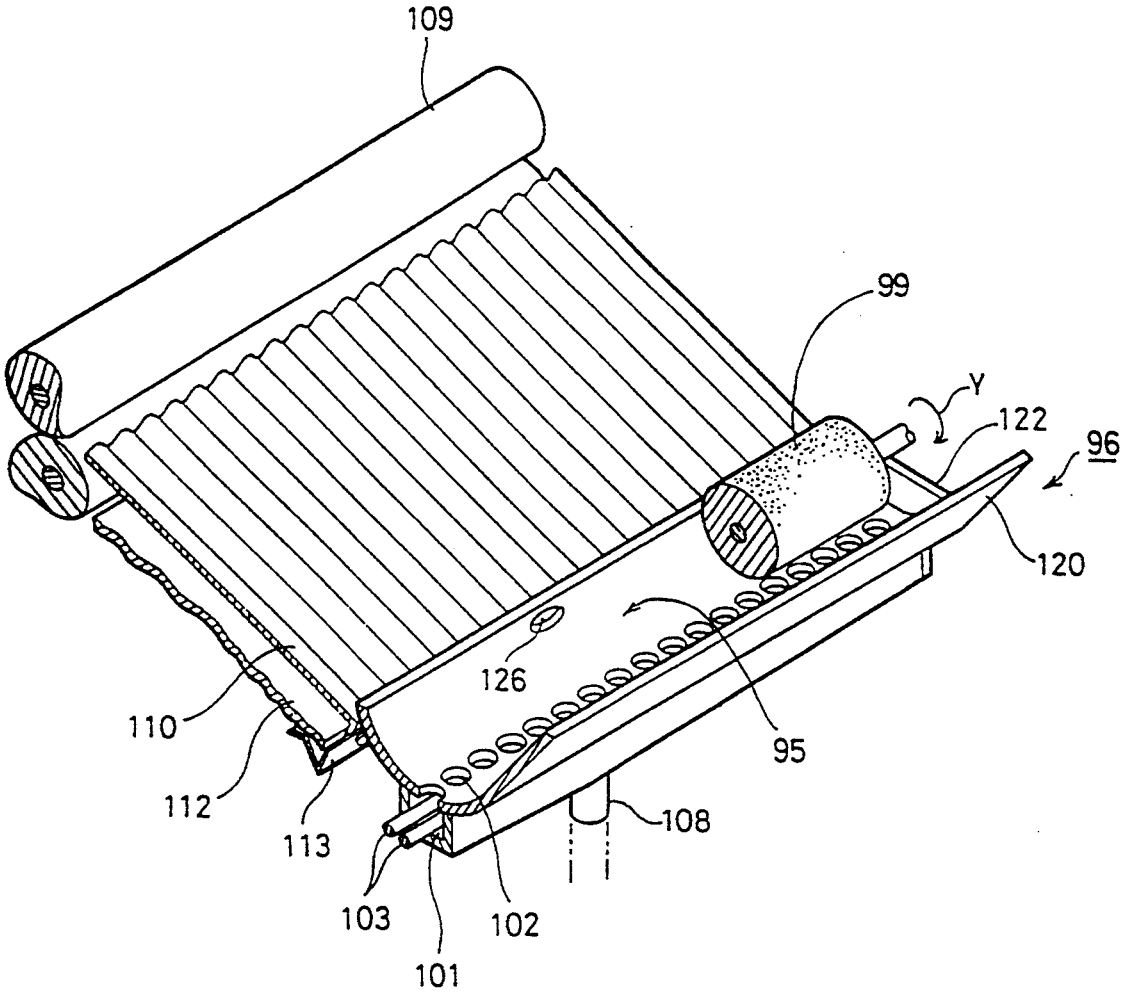
FIG. 3 is a perspective view illustrating a process tank 96.
Figure 5:
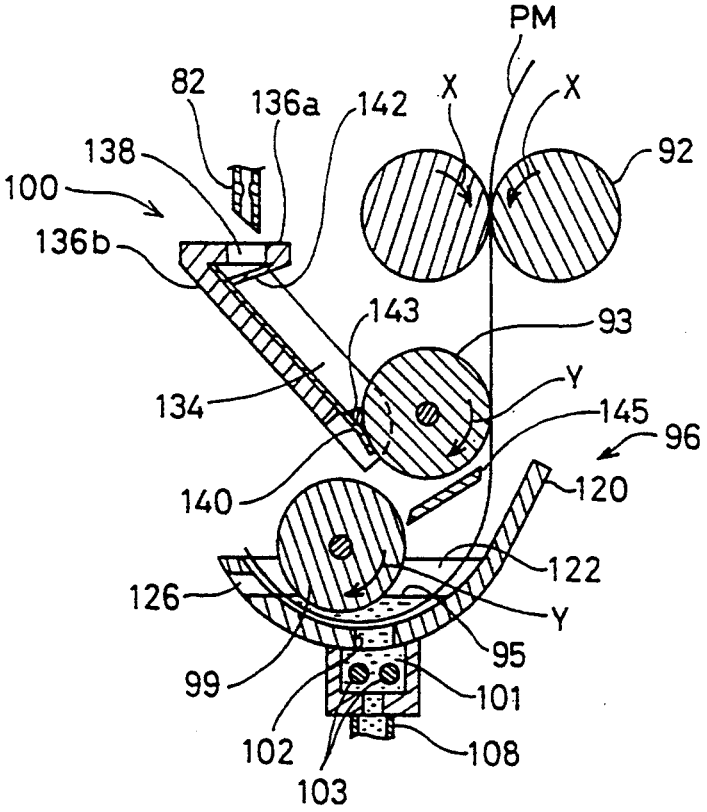
FIG. 5 is a cross sectional view illustrating the arrangement of the developer applying roller 93 and the temporary reservoir 100 with the process tank 96.

The process tank 96 has a U-shaped cross section; as FIG. 3 shows, it has a width corresponding to the width of the photosensitive material PM and forms a reservoir 94. Inside the process tank 96, auxiliary roller 99 rotates in a direction shown by the arrow Y on FIG. 5, is mounted parallel to the tank 96 and at a certain distance from the bottom of the process tank 96. When developer is stored in the reservoir 95 of the process tank 96, the lower portion of the developer supply roller 93 is soaked in developer.

A bottom reserve chamber 101 is formed at the bottom of the process tank 96 as seen in FIGS. 3 and 5. Developer flows in and out through plural apertures 102 formed on the bottom of the process tank 96. The bottom reserve chamber 101 is provided with two bar heaters 103 for heating the developer. A developer discharge pipe 108 formed below the center of the bottom reserve chamber 101 is connected to the bottom reserve chamber 101 via the electromagnetic valve 104 for opening and closing the discharge pipe 108, and drains the used developer into the waste tray 106. As shown in FIG. 1, a cover 114 is mounted on the electromagnetic valve 104 to guard the valve from the developer dropping from the process through 96 and a guide plate 110.

A guide plate 110 having a predetermined angle of elevation $\alpha$ against the fixation unit 72 is disposed on the opposite side of the process tank 96. As shown in FIG. 3, the guide plate 110 is corrugated so as to decrease the contact resistance to the photosensitive material PM, and feeds the developed photosensitive material PM to a pair of wring rollers 109 of the fixation unit 72. A panel heater 112 having a function of self-temperature-stabilizing is attached to the lower face of the guide plate 110. The panel heater 112 is securely fixed to the guide plate 110 with a fixture 113 attached to the process tank 96 and other fixtures as shown in FIG. 3. When electricity is sent, the heater 112 generates heat to maintain the temperature of atmosphere above the guide plate 110 in the vicinity of a predetermined value.

Details of the process tank 96 are described now. The reservoir 95 of the process tank 96, as shown in FIG. 3, includes a curved plate and arc-shaped side plates 122

(side plate on the left is omitted in FIG. 3) joined with and fixed to both the ends of the curved plate 120. A through hole 126 is formed near the center of the curved plate 120 on the side of the guide plate 110. When the liquid level increases, developer flows out of the through hole 126. Namely, the level of developer is maintained at the height of the through hole 126. Developer flowing out of the through hole 126 and along the guide plate 110 drops on a cover 114 mounted on an electromagnetic valve 104 disposed immediately below the process thank 96 and is collected in a waste tray 106.

To the reservoir 95, the developer dropped from the developer nozzle 82 is carried with the developer applying roller 93 and the photosensitive material PM. The developer is also supplied from another nozzle 83 located in parallel with the nozzle 82. The developer from the developer nozzle 83 is supplied to the empty reservoir 95 and the empty bottom reserve chamber 101 for providing a process of the development. Chamber 101 is defined by a transverse groove at the bottom of reservoir 95.

The temporary reservoir 100 shown in FIGS. 4 and 5 includes: two side plates 134 in contact with either side of the developer applying roller 93 to allow rotation of the roller 93; and a support plate 136 of a numeral "7" shape connecting the side plates 134 on the side ends of the plate 136. A hole 138, which developer passes through, is formed at a position corresponding to the end of the developer nozzle 82 on the center of an upper plate 136*a* of the support plate 136. A stainless steel leaf spring 140, which is mounted on a rear plate 136*b* of the support plate 136, is pressed against the developer applying roller 93 to be in contact with the circumference of the roller 93.

A developer saucer 142 mounted directly below the hole 138 extends from the front center of the upper plate 136*a* towards the leaf spring 140. There is a small space between the end of the developer saucer 142 and the leaf spring 140. A basin 143 defined by the developer applying roller 93 rotating clockwise, the side plates 134, and the leaf spring 140 pressed against the circumference of the roller 93 can temporarily store developer dripped down from the developer nozzle 82.

The developer saucer 142 efficiently spreads developer along the axis of the developer supply roller 98. Developer is, however, spread along the axis of the developer supply roller 98 even without the developer saucer 142 since the developer is temporarily stored in the basin 143.

Developer dropped down from the developer nozzle 82 passes through the hole 138 to the developer saucer 142, runs from the sides of the developer saucer 142 and through the space between the saucer 142 and the leaf spring 140, and flows down along the surface of the leaf spring 140 as seen in FIGS. 4 and 5. The developer is accordingly spread along the axis of the developer applying roller 93 and is temporarily stored in the basin 143. Part of the developer stored in the basin 143 is held in the separate pores on the surface of the developer applying roller 93 and drawn out with rotation of the roller 93 in a direction shown by the arrow Y of FIG. 5. The photosensitive material PM is conveyed synchronously with the rotation of the developer applying roller 93, and developer held on the surface of the roller 93 is applied onto the exposed face of the photosensitive material PM with the rotation of the developer applying roller 93. The application of developer starts development of the photosensitive material PM. Since the pores are evenly formed along the axis on the surface of the developer applying roller 93, developer is uniformly held on the roller 93 and evenly applied onto the exposed face of the photosensitive material PM. Preferably, and as clearly illustrated in FIG. 5, engagement between photosensitive material PM and roller 93 is by nip free pressing. That is, in the region where material PM is engaged with roller 93, there is no instrumentality that engages the surface of material PM facing away from roller 93 to press material PM against roller 93, as occurs in a construction where a web passes through the nip formed between two rolls.

Developer applied to the exposed face of the photosensitive material PM is conveyed to the reservoir 95 with the photosensitive material PM. A slant saucer 145 disposed immediately below the developer applying roller 93 against the auxiliary roller 99 prevents developer from being dropped down from the surface of the developer applying roller 93 onto the surface of the conveyed photosensitive material PM and causing uneven development.

Developer flown into the bottom reserve chamber 101 is heated with the bar heaters 103 and circulated through the apertures 102 to the reservoir 95. Flow of electricity to the bar heaters is controlled based on feed-back data on the temperature of developer detected by a temperature detector, and hence developer in the process tank 96 is heated in a very short time period and maintained at a predetermined temperature.

When the photosensitive material PM is conveyed through developer in the reservoir 95 of the process tank 96, sludge is formed in the developer. The sludge is discharged from the reservoir 95 to the bottom reserve chamber 101, and drained together with the used developer through the discharge pipe 108 into the waste tray 106 while the electromagnetic valve 104 opens.

Conveyance of the photosensitive material PM is described in detail. The exposed photosensitive material PM fed by a pair of feed rollers 92 is conveyed to the reservoir 95 while the exposed face thereof being pressed against the surface of the developer applying roller 93 rotating in the direction Y of FIG. 5. New or unused developer held in the separate pores on the sponge surface of the developer applying roller 93 is applied onto the photosensitive material PM by the press against the roller 93. Since conveyance of the photosensitive material PM is synchronized with rotation of the developer applying roller 93 and the surface of the roller 93 is covered with sponge, the surface of the photosensitive material PM is not damaged by the press against the developer applying roller 93. The photosensitive material PM running through the developer applying roller 93 is soaked in developer stored in the reservoir 95 and conveyed through the process tank 96 along the inner face of the curved plate 120.

When the photosensitive material PM is pressed against the surface of the developer applying roller 93, unused developer held on the surface starts development of the photosensitive material PM. While the photosensitive material PM is conveyed through the process tank 96, developer stored in the reservoir 95 continues development thereof. The photosensitive material PM runs out of the reservoir 95 through the space defined by the auxiliary roller 99 and the curved plate 120, and is conveyed along the upper face of the slant guide plate 110 to the pair of wring rollers 109 mounted on the inlet of the fixation unit 72. The temperature of atmosphere above the guide plate 110 is controlled in the vicinity of a predetermined value by heating with the panel heater 112 with the temperature control function. Development of the photosensitive material PM is proceeded with developer adhering to the surface of the material PM during conveyance along the guide plate 110, and is completed before the photosensitive material PM reaches the wring rollers 109. Developer left on the surface of the photosensitive material PM is wrung out and removed by the pair of wring rollers 109.

The fixation unit 72 for fixing the photosensitive material PM is now described in detail based on FIG. 2. The fixation unit 72 includes similar members or members of similar functions as the development unit 70, which are not described here and shown by the same numerals as the development unit 70 plus the letter A.

The fixation unit 72 includes: a main fixer tank 43; a liquid level control cylinder 74A detachably mounted on the main fixer tank 43; an fixer cistern tank 78A with an upright panel 84A therein; a conduit 76A for connecting the liquid level control cylinder 74A to the fixer cistern tank 78A; and fixer nozzles 82A and 83A equipped with electromagnetic valves 80A and 81A. The fixer cistern tank 78A further includes a float sensor 88A with a float 87A and a mesh filter 90A as in the developer cistern tank 78. When used fixer is discharged from the fixer cistern tank 78A via the electromagnetic valves 80A and 81A and the fixer nozzles 82A and 83A, new fixer of the same volume is supplied through the conduit 76A from the main fixer tank 43.

Other constituents of the fixation unit 72 are briefly described according to conveying process of the photosensitive material PM. The photosensitive material PM passing through the pair of wring rollers 109 disposed on the guide plate 110 of the development unit 70 is curved along a guide cover 144 and runs between the lower roller of the pair 109 and a guide roller 146 to be conveyed downstream.

The photosensitive material PM is then conveyed into a reservoir 95A of a fixation tank 96A while the developed face thereof is being pressed against the surface of a fixer applying roller 93A. The fixer applying roller 93A, which is covered with sponge in the same manner as the developer applying roller 93, draws new or unused fixer out of a basin 143A defined by the roller 93A and a temporary reservoir 100A with rotation of the roller 93A. The fixer drawn out and held on the roller 93A is applied onto the developed face of the photosensitive material PM while the photosensitive material is pressed against the surface of the fixer applying roller 93A.

The fixation tank 96A forming the reservoir 95A of fixer includes: a fixer saucer 145A arranged immediately below the fixer applying roller 93A; an auxiliary roller 99A; and a bottom reserve chamber 101A formed on the bottom of the fixation tank 96A. When an electromagnetic valve 104A with a cover 114A is opened, used fixer is discharged from the bottom reserve chamber 101A to a waste tray 106A via a fixer discharge pipe 108A. No heater is disposed in the bottom reserve chamber 101A since fixer does not require heating and temperature control.

A guide plate 110A ascending from the fixation tank 96A is disposed downstream of the fixation tank 96A for feeding the fixed photosensitive material PM. A pair of wring rollers 109A are disposed on the upper end of the guide plate 110A and rotate in a direction shown by the arrow Z of FIG. 2. Accordingly, the fixed photosensitive material PM is conveyed to the rollers 51 of the dry unit 50 (see FIG. 1) and wrung to discharge excess of fixer in which the surface of the photosensitive material PM is drenched. The fixer applying roller 93A and the wring rollers 109 and 109A are driven by the same driving source as the rollers of the process tank 96 and synchronously rotated.

A plane including the center of each roller pair 109 or 109A is shifted counterclockwise from a vertical plane including the center of the lower roller of each pair by an angle $\beta$. Namely, the photosensitive material PM is conveyed along the wring rollers 109 and 109A downward at an angle corresponding to $\beta$. Wrung-out developer or fixer thus remains in a space between the surface of the photosensitive material PM and the circumference of the upper roller of the wring roller pair 109 or 109A and does not drop on the photosensitive material PM.

Immediately after the rear end of the photosensitive material PM passes through the wring rollers 109 or 109A, developer or fixer remaining in the space flows along the surface of the lower roller of the roller pair 109 or 109A and drips down along a right collection panel 152 or a left collection panel 154 to the waster tray 106A.

Each roller of the wring roller pair 109 or 109A is engaged with a scraper 150. The scraper 150 is composed of material having corrosion resistance and elasticity, for example, a stainless steel plate with a polished end or with an end covered with plastics to make itself durable as well as to protect the surface of the rollers 109 or 109A. The end of the scraper 150 may be covered with plastics having chemical and abrasion resistance such as fluororesin, polyester, or vinyl chloride resin.

Sludge or waste scraped away by the scraper 150 drops on the right collection panel 152 or the left collection panel 154 to be collected on the waste tray 106A. Each of the waste trays 106 and 106A of the development unit 70 and the fixation unit 72 is connected to a waste tank 156 through a pipe 158. Accordingly, waste or sludge on the trays 106 and 106A is discharged to the waste tank 156.

In the fixation unit 72 thus constructed, the developed photosensitive material PM conveyed from the development unit 70 is wrung by the pair of wring rollers 109 and conveyed downstream. While the photosensitive material PM is pressed against the surface of the fixer applying roller 93A, new or unused fixer held in separate pores on the surface of the roller 93A is applied onto the surface of the material PM. The new fixer starts fixation of the photosensitive material PM. Fixation of the photosensitive material PM is proceeded while the photosensitive material PM is conveyed through the reservoir 95A and along the guide plate 110A. Excess of fixer on the surface of the photosensitive material PM is wrung out and removed by the pair of wring rollers 109A, and the photosensitive material PM is then transferred to the dry unit 50 via the roller pair 51.

Figure 6:
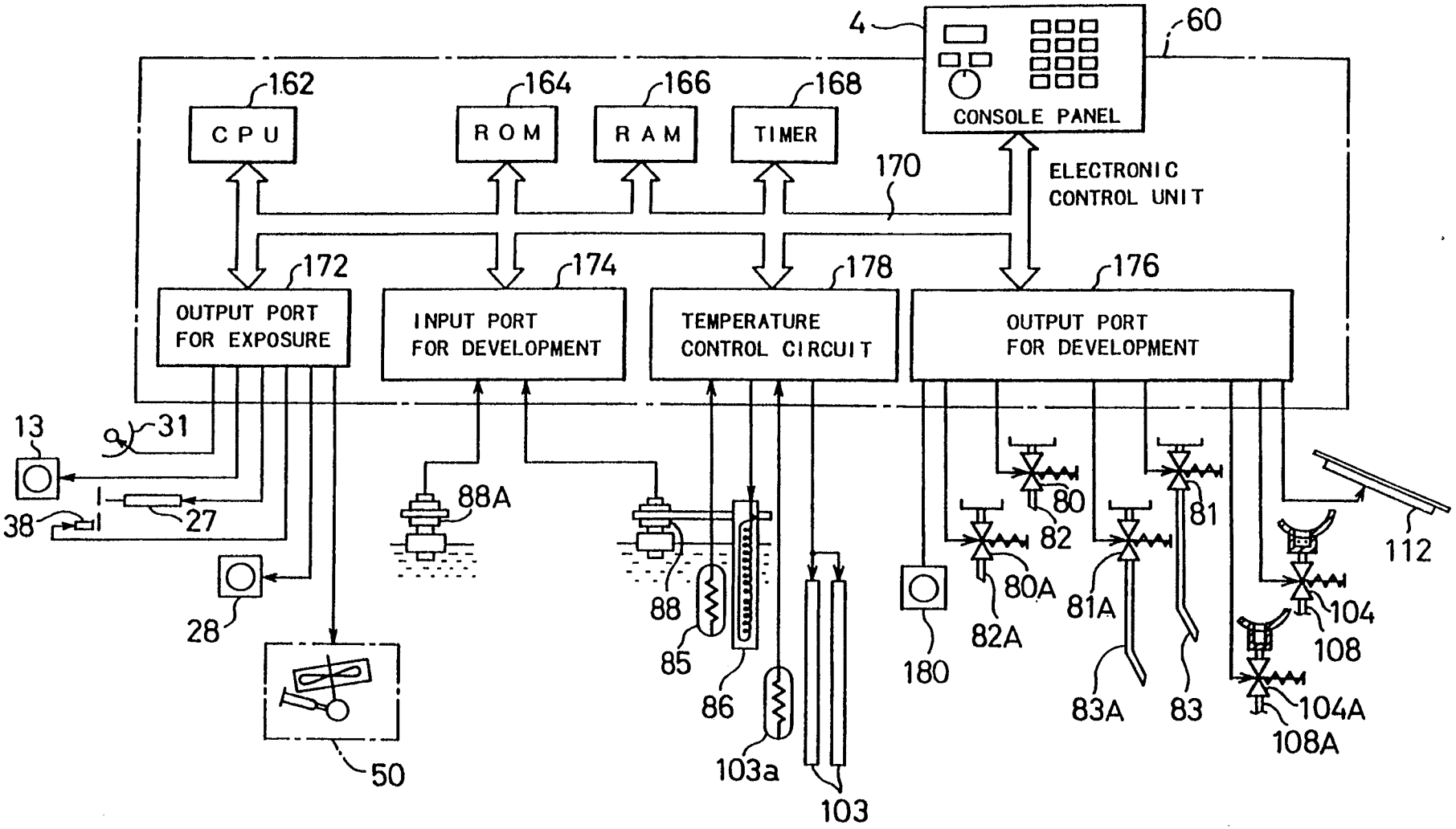
FIG. 6 is a block diagram showing structure of an electronic control unit 60.

The electronic control unit 60 is described in detail according to a block diagram of FIG. 6. The electronic control unit 60 controls the temperature of, for example, the developer cistern tank 78 and actuates and controls rollers including the developer applying roller 93.

As shown in FIG. 6, the electronic control unit 60 is an arithmetic logic operation circuit including: a CPU (central processing unit) 162; a ROM (read only memory) 164; a RAM (random access memory) 166; and a timer 168 with plural independent timer counters. The electronic control unit 60 further includes an output port for exposure 172, an input port for development 174, an output port 176 for development, and other input/output interfaces. The above elements and ports are connected to one another via a common bus 170. The common bus 170 of the electronic control unit 60 is further connected to a temperature control circuit 178 and the console panel 4 used for manual setting. The temperature control circuit 178 controls the temperature of developer in the developer cistern tank 78, accordingly the temperature of the developer dropped from the developer nozzle 82 and drawn out the basin 143 with the rotation of the developer applying roller 93, and the temperature of the developer in the reservoir 95 joined to the bottom reserve chamber 101.

The output port for exposure 172 is connected to: the motor 13 for driving the holder 10; the cutting device 27 for cutting the photosensitive material PM; the light source 31 for irradiating an original in the holder with light; the motor 28 for feeding the photosensitive material PM from the first roll 21 or the second roll 22; the LED 38 for exposing the photosensitive material PM uniformly; and the dry unit 50 for drying the fixed photosensitive material PM.

The input port for development 174 is connected to: the float sensor 88 in the developer cistern tank 78; and the float sensor 88A in the fixer cistern tank 78A. The output port for development 176 is connected to: a drive motor 180 for driving the rollers of the process unit 44 synchronously; the electromagnetic valves 80, 81, 80A, and 81A respectively mounted on the developer nozzles 82 and 83, the fixer nozzles 82A and 83A, the electromagnetic valves 104 and 104A respectively mounted on the developer discharge pipe 108 and the fixer discharge pipe 108A; and the panel heater 112 for heating atmosphere above the guide plate 110 to a predetermined temperature.

The temperature control circuit 178 is connected to: the heater 86 disposed in the developer cistern tank 78; a temperature sensor 85 for detecting the temperature of developer in the tank 78; the two heater bars 103 disposed in the bottom reserve chamber 101; and a temperature sensor **103*a* for detecting the temperature of developer in the chamber 101. The temperature control circuit 178 controls the heaters so as to maintain the temperature of developer in the reservoir 95 and the developer cistern tank 78. Consequently the temperature of developer applied on the surface of the photosensitive material PM is maintained constant. The temperature control circuit 178 outputs a signal, which shows whether the temperature is maintained in a predetermined range, to the CPU 162**.

Figure 7:
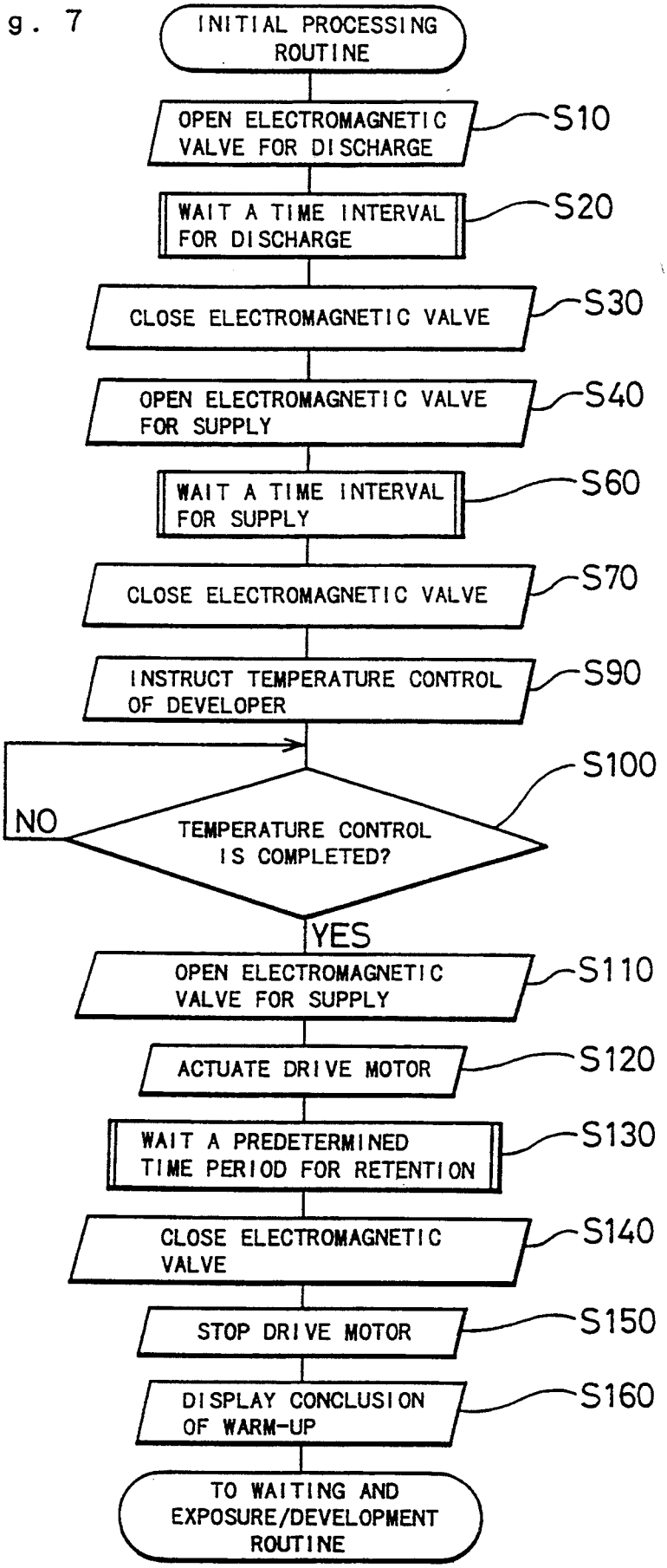
FIG. 7 is a flowchart showing an initial processing routine executed by the electronic control unit 60 of FIG. 6.
Figure 8:
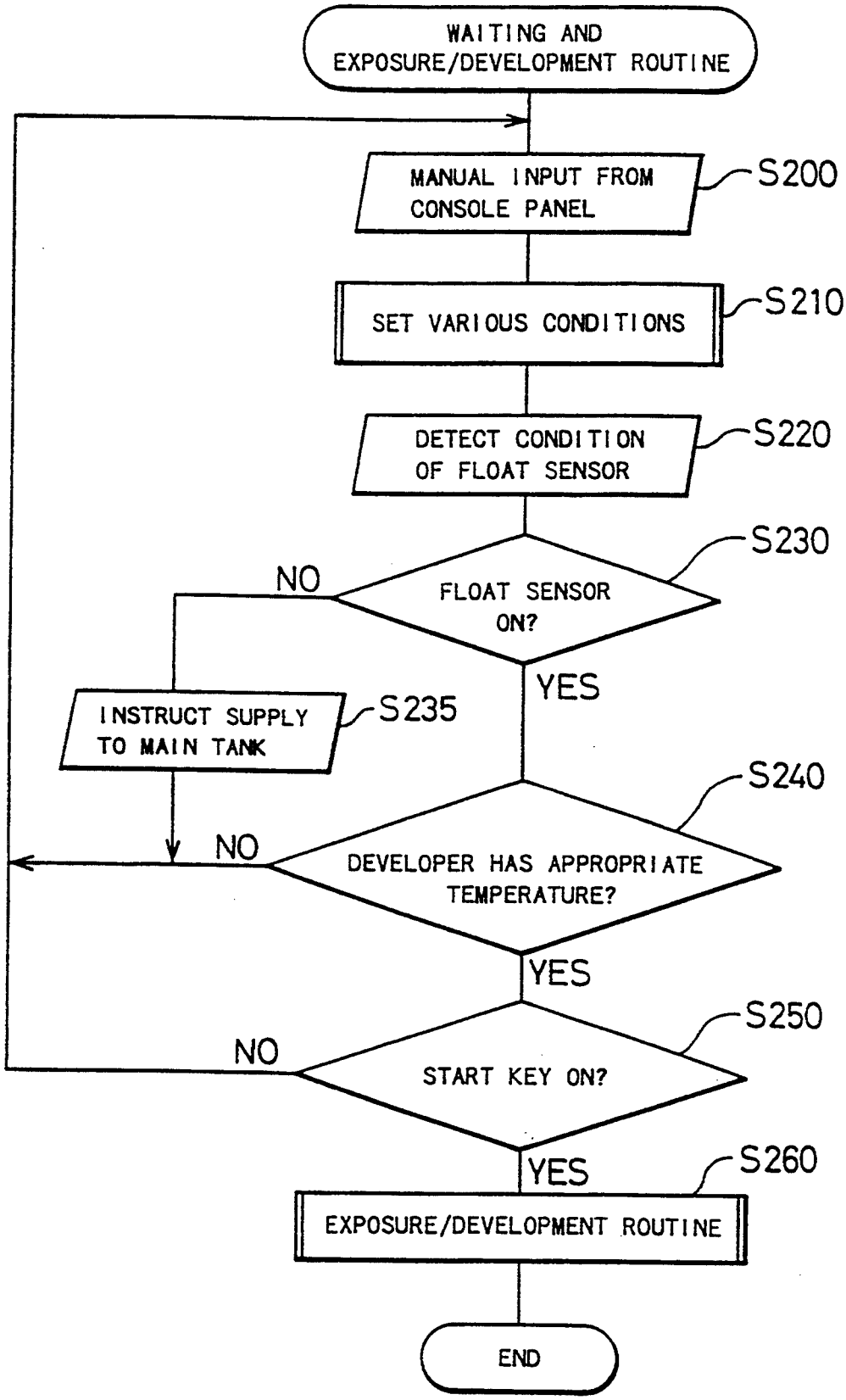
FIG. 8 is a flowchart showing a waiting and exposure/development routine.

Processing executed by the electronic control unit 60 in the slit exposure process camera 1 is described based on flowcharts of FIGS. 7 and 8. The flowchart of FIG. 7 shows an initial processing routine executed when the power is supplied; FIG. 8 shows a waiting and exposure/development routine for exposing and developing the photosensitive material PM.

When the power is supplied to the slit exposure process camera 1, the electronic control unit 60 executes the initial processing routine of FIG. 7. This processing is executed only once at the start of operation of the process camera 1.

When the routine starts, the electromagnetic valves 104 and 104A are opened at step S10 for discharging developer and fixer. At step S20, the electronic control unit 60 waits a certain time period sufficient to discharge developer and fixer (hereinafter referred to as the processing solution as appropriate) from the process tank 96 and the fixation tank 96A (hereinafter referred to as the tank 96 as appropriate). Since the volume of the processing solution in the tank 96 predetermined, the waiting time is easily calculated and preset.

After a predetermined waiting time for discharge, the electromagnetic valves 104 and 104A for discharge are closed at step S30, and the electromagnetic valves 81 and 81A for supply are opened at step S40. When the electromagnetic valves 81 and 81A are opened, processing solution is discharged from the developer cistern tank 78 and the fixer cistern tank 78A via the developer nozzle 82 and the fixer nozzle 82A and directly supplied to the process tank 96.

The electronic control unit 60 waits a predetermined time period for supply of processing solution into the process tank 96 at step S60. When the process tank 96 is filled with processing solution required for development or fixation, the program proceeds to step S70 at which the electromagnetic valves 81 and 81A are closed.

On completion of supply, a start signal for controlling the temperature of developer is output to the temperature control circuit 178 at step S90. The temperature control circuit 178 receives the start signal and supplies power to the heaters 86 and 103 by referring to detected signals of the temperature sensors 85 and **103*a* so as to control the temperature of developer in the developer cistern tank 78 and the process tank 96 in a predetermined range. While the temperature of developer in the process tank 96 is controlled in a range between 28 and 31 degrees centigrade, the same in the developer cistern tank 78 is regulated little higher, so that the temperature of developer dropped from the developer nozzle 82 and temporarily stored in the basin 143 is maintained in the above range (28 to 31 degrees centigrade). Heaters may preferably be built in the developer applying roller 93 and the temporary reservoir 100 to accurately control the temperature of developer in the basin 143** in the predetermined range.

When the temperature control circuit 178 adjusts the temperature of developer in the predetermined range by heating, it outputs a signal representing completion of the control to the CPU 162. The electronic control unit 60 determines whether the temperature of developer in the developer cistern tank 78 and the process tank 96 is maintained in the predetermined range, that is, whether the temperature control is completed, at step S100, and waits until the signal representing completion of the control is output.

When the electronic control unit 60 receives the signal of completion, it opens the electromagnetic valves 80 and 80A at step Sl10 and actuates the drive motor 180 via the output port for development 176 at step S120.

When the electromagnetic valves 80 and 80A are opened, processing solution controlled in the predetermined temperature range at step S100 is discharged from the developer cistern tank 78 and the fixer cistern tank 78A via the developer nozzle 82 and the fixer nozzle 82A to the basins 143 and 143A. While the developer applying roller 93 and the fixer applying roller 93A are actuated and rotated by the drive motor 180, processing solution is drawn out of the basins 143 and 143A to be uniformly held on the surface of the rollers 93 and 93A.

The electronic control unit 60 waits a predetermined time period for retention of processing solution at step S130, closes the electromagnetic valves 80 and 80A at step S140, and cuts power supply to the drive motor 180 to stop rotation of the rollers 93 and 93A at step S150.

When processing solution held on the roller 93 or 93A exceeds a maximum retentive volume (maximum volume the pores are held), the excess of processing solution is dropped from the surface of the roller 93 or 93A to the process tank 96.

When processing solution is sufficiently stored in the process tank 96 and uniformly held on the surface of the developer applying roller 93 and the fixer applying roller 93A, the CPU 162 displays conclusion of warm-up on the console panel 4 at step S160, and exits from the initial routine to proceed to the waiting routine.

Through the process of the initial routine described above, the processor 40 of the slit exposure process camera 1 discharges used processing solution (developer or fixer) from the process tank 96 or the fixation tank 96A with sludge, supplies new processing solution to the tank 96 or 96A, and controls the temperature of developer in the required range.

The waiting and exposure/development routine of FIG. 8 is executed after conclusion of the initial processing routine. At step S200, various conditions are manually input with keys on the console panel 4. The program then proceeds to step S210 at which various conditions including the size of an original and the intensity of exposure are set corresponding to the input. The electronic control unit 60 detects conditions of the float sensors 88 and 88A of the developer cistern tank 78 and the fixer cistern tank 78A at step S220, and judges whether the float sensor 88 or 88A is ON at step S230. When either of the float sensors 88 and 88A is OFF, that is, when the liquid level of the main developer tank 42 or the main fixer tank 43 is lowered, the electronic control unit 60 displays a signal for instructing further supply of developer of fixer to the main tank 42 or 43 on the console panel 4 at step S235. The program then returns to step S200 and repeats steps S200 through S230.

On the other hand, when the float sensors 88 and 88A are judged to be ON at step S230, the program proceeds to step S240 at which it is judged whether the temperature of the developer is appropriate. When the answer is YES, the program proceeds to step S250 at which it is judged whether a start key on the console panel 4 is turned on for instructing the start of exposure. The temperature of the developer is controlled by the temperature control circuit 178 and is supposed to be adjusted to an adequate range in the initial processing routine of FIG. 7. The temperature is, however, rechecked against a malfunction of the heaters 86 and 103. The program repeats steps S200 through S250 until the developer is maintained at the appropriate temperature and the start key is pressed on.

When the above requirements are fulfilled, the program proceeds to step S260 at which exposure and development are executed, and exits the waiting routine. Exposure and development executed at step S260 include: conveyance of the holder 10 with an original; exposure of the photosensitive material PM by the optical projection system 30; feed-out of the photosensitive material PM synchronized with conveyance of the holder 10; development and fixation by the processor 40; cutting of the photosensitive material PM with the cutting device 27; and drying of the photosensitive material PM with the panel heater 112 and the dry unit 50. The photosensitive material PM exposed by the optical projection system 30 is pressed against the surface of the developer applying roller 93 and covered with developer in the processor 40. Development is proceeded until the photosensitive material PM passes through the process tank 96 to the fixation unit 72. The developed photosensitive material PM is fixed in the fixation unit 72, sufficiently dried, and fed to the tray 56 mounted outside the casing 2 as a plate for off-set printing.

As described above, in the processor 40 of the slit exposure process camera 1, new or unused developer or fixer temporarily stored in the basin 143 or 143A is uniformly held in separate pores on the surface of the developer applying roller 93 or the fixer applying roller 93A along the width of the roller 93 or 93A or the photosensitive material PM. With rotation of the developer applying roller 93 or the fixer applying roller 93A, processing solution held in the pores is uniformly applied onto the exposed face of the photosensitive material PM for development or fixation. Since the photosensitive material PM is processed with new or unused and uniform processing solution at the initial stage, the whole photosensitive material PM is uniformly developed and fixed.

Since the processor 40 of the embodiment does not require a large volume of developer or fixer stored, it is free from deterioration of processing solution or oxidation of alkaline developer even when a large number of photosensitive materials PM are processed, thus maintaining the quality of processed photosensitive materials PM. New or unused processing solution is directly applied onto the surface of the photosensitive material PM by the applying roller 93 or 93A. Since a required amount of processing solution is accurately applied to the photosensitive material PM at the initial stage of processing, the amount of processing solution is reduced and development and fixation are efficiently controlled.

The processor of the embodiment does not require troublesome replacement of a large volume of processing solution and, moreover, easily discharges sludge in the processing solution, thus saving time and labor for maintenance and warm-up.

In the embodiment, development or fixation is started on application of processing solution by the developer applying roller 93 or the fixer applying roller 93A and is proceeded with the solution in the process tank 96 or the fixation tank 96A for further improvement of processing quality.

Such a structure allows a smaller process tank 96 or 96A, a smaller processor 40, and thereby a smaller slit exposure process camera 1.

The processor of the embodiment automatically discharges sludge in the process tank 96 or 96A with used processing solution at the start of processing to prevent accumulation of sludge on the bottom of the tank. In the embodiment, smooth conveyance of the photosensitive material PM is not hindered by accumulated sludge and thus ensures stable and uniform development.

The fixation tank 96A has a similar structure to the process tank 96 except the heaters, and contributes to improvement of processing quality in the same manner as the process tank 96.

Other embodiments of the invention are described hereinafter. Elements of the same structure or function are not explained in detail and are shown by the same numerals as the development unit 70 of the first embodiment.

Figure 9:
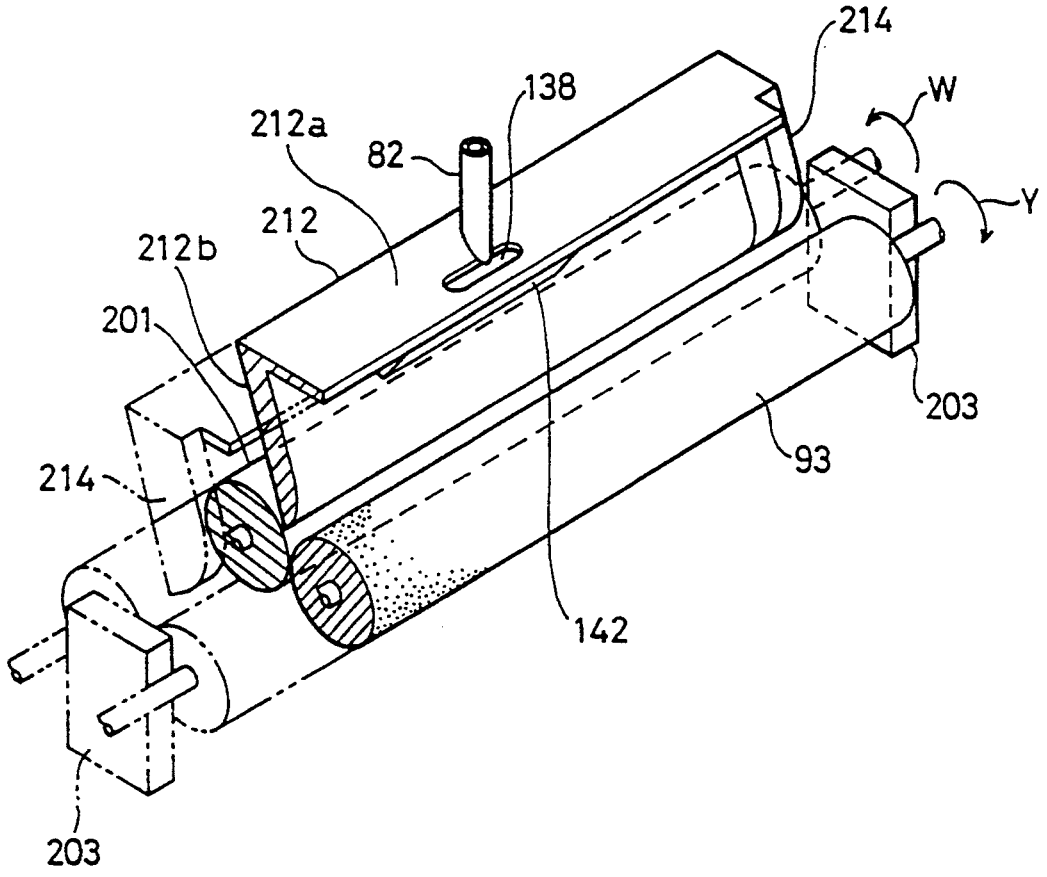
FIG. 9 is a schematic view showing a construction of the developer applying roller 93 of other embodiment according to the invention.
Figure 10:
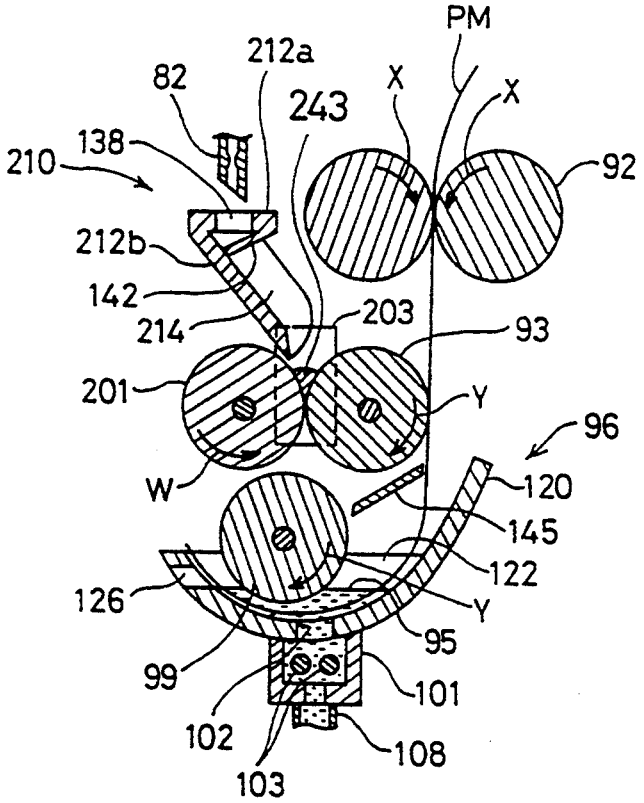
FIG. 10 is a cross sectional view illustrating the arrangement of the developer applying roller 93 and a supply unit 210 with a process tank 96.

FIGS. 9 and 10 show a processor according to a second embodiment of the invention. Primary points of difference include: a basin 243 defined by two rollers; and a supply unit 210 which supplies processing solution to the basin 243 without being in contact with the developer applying roller 93.

As shown by FIGS. 9 and 10, the developer applying roller 93, which rotates in the direction Y to be in contact with the exposed face of the photosensitive material PM, and a driven roller 201, which is engaged with the roller 93 along the width and rotates in the direction W, are arranged below the pair of feed rollers 92. The driven roller 201 is made of a material which does not hold developer on the surface thereof, for example, of fluororesin. The driven roller 201 has a predetermined nip pressure against the developer applying roller 93 so as to prevent leak of solution from the contact with the developer applying roller 93.

The rollers 93 and 201 are rotatably engaged with two support plates 203 attached to the sides of the rollers 93 and 201. The basin 243 for temporarily storing developer is defined by the developer applying roller 93, the driven roller 201, and the support plates 203.

The supply unit 210 for supplying developer to the basin 243 is disposed above the driven roller 201. The supply unit 210 includes: a 7-shaped support plate 212 which is little shorter than the developer applying roller 93; and end plates 214 fixed on both the ends of the support plate 212. An upper panel **212*a* of the support plate 212 has: a hole 138 formed on the center thereof; and a developer saucer 142 which is disposed immediately below the hole 138 and projected from the front end of the upper panel 212*a* to a base panel 212*b* of the support plate 212**.

Developer dropped down from the developer nozzle 82 passes through the hole 138 to the developer saucer 142, and runs along the surface of the base panel **212*b*. The developer is accordingly spread along the axis of the developer applying roller 93 and is temporarily stored in the basin 243. With rotation of the developer applying roller 93, developer in the basin 243 is drawn out and held on the surface of the roller 93. Developer on the surface of the roller 93** is then uniformly applied onto the exposed face of the photosensitive material PM in the same manner as described in the first embodiment.

The structure of the second embodiment also maintains processing quality and improves usability of the processor. In the second embodiment, a certain amount of developer is directly supplied from the basin 243 through the contact between the rollers 93 and 201 to the process tank 96 by controlling the nip pressure of the driven roller 201 against the developer applying roller 93. Accordingly, the electromagnetic valve 81 and the developer nozzle 83 for supplying developer to the process tank 96 are not required in this embodiment.

Figure 11:
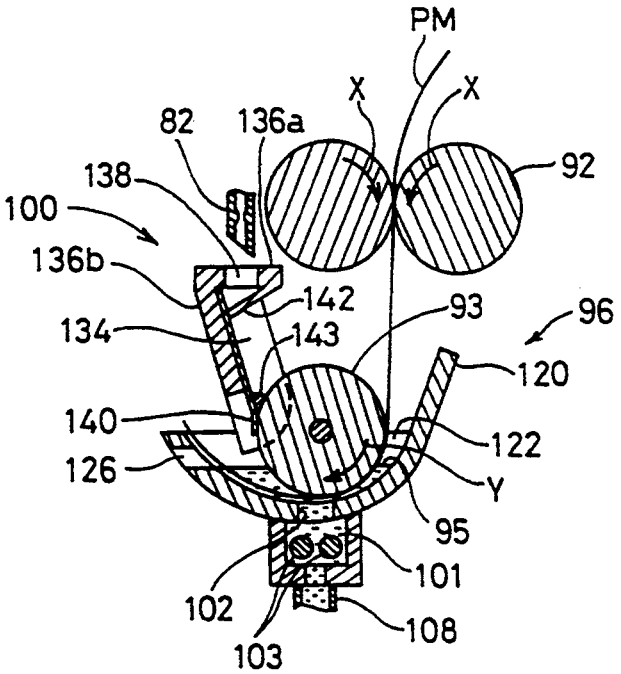
FIG. 11 is a cross sectional view illustrating the arrangement of a developer applying roller 93 and a temporary reservoir 100 with the process tank 96.

A third embodiment of the invention is described based on FIG. 11. In a processor according to the third embodiment, the developer applying roller 93 is disposed at such a position that the roller 93 also functions as the auxiliary roller 99.

The developer applying roller 93 disposed below the pair of feed rollers 92 to be in contact with the exposed face of the photosensitive material PM is placed at such a position that the roller 93 is partly soaked in developer in the process tank 96 and works as the auxiliary roller 99 (see FIG. 5) as well while the relative position to the feed roller pair 92 remains unchanged. The basin 143 is defined by the developer applying roller 93, and the side plates 134 and the leaf spring 140 of the temporary reservoir 100.

Developer dropped down from the developer nozzle 82 passes through the hole 138 to the developer saucer 142, and runs along the surface of the leaf spring 140. The developer is accordingly spread along the axis of the developer applying roller 93 and is temporarily stored in the basin 143. With rotation of the developer applying roller 93, part of developer in the basin 143 is drawn out and held on the surface of the roller 93. Developer on the surface of the roller 93 is then uniformly applied onto the exposed face of the photosensitive material PM. Development of the photosensitive material PM is started on application of developer and proceeded during conveyance through the process tank 96.

The structure of the third embodiment also maintains processing quality and improves usability of the processor. The photosensitive material PM is conveyed into the process tank 96 immediately after application of developer by the developer applying roller 93, thus being uniformly developed. The third embodiment has a simpler structure than the first embodiment since it has neither the auxiliary roller 99 nor the saucer 145 between the auxiliary roller 99 and the developer applying roller 93.

Since there may be many modifications and changes without departing from the scope of the invention, the embodiments above are not intended to limit the invention to the embodiments but are intended to illustrate the invention more clearly. Examples of modifications include: application of the invention to either of development and fixation; use of a rough surface abrasive roller or a porous soft plastic roller instead of the roller with separate pores for supply and application of processing solution; feed-back control of developer supply; discharge of used processing solution left in the process tank after processing of a certain area or a certain number as well as start of the processor; processing of the photosensitive material only with new processing solution applied by the applying roller (without the process tank); and application of the invention to developing devices for silver salt printing paper or reproduction films.

What is claimed is:

1. An apparatus for processing a silver salt photosensitive material such as printing paper or photosensitive paper or film for direct plate making, comprising:

a rotating liquid retentive roller with liquid retentive surface, which is disposed along the width of said photosensitive material conveyed after completion of exposure;

supply means for providing processing solution that is applied onto the surface of said liquid retentive roller;

first means for holding processing solution on the surface of said liquid retentive roller;

application means for applying said processing solution onto the surface of said photosensitive material by nip free pressing of said photosensitive material against said liquid retentive roller with the processing solution held thereon and conveying said photosensitive material in the rotational direction of said liquid retentive roller.

2. An apparatus in accordance with claim 1, in which said first means includes a member pressed against the circumference of said liquid retentive roller along the width thereof; and said means temporarily storing a predetermined amount of said processing solution between said liquid retentive roller and said member.

3. An apparatus in accordance with claim 1, further comprising: a process tank for storing processing solution of the photosensitive material, which is disposed on the downstream side of said retentive roller and on the conveyance pathway of said photosensitive material with the processing solution applied thereto.

4. An apparatus in accordance with claim 3, further comprising a delivery unit for supplying processing solution to said process tank.

5. An apparatus in accordance with claim 4, wherein processing solution is supplied to said process tank by said delivery unit while the photosensitive material is not in said process tank.

6. An apparatus in accordance with claim 1, wherein said processing solution applied onto the surface of the photosensitive material by said application means is either developer of the photosensitive material or fixer of the developed photosensitive material.

7. An apparatus in accordance with claim 1, wherein the surface of said liquid retentive roller disposed along the width of said photosensitive material is made of sponge containing a lot of separate pores.

8. An apparatus in accordance with claim 2, wherein said member pressed against the circumference of said liquid retentive roller is a driven roller, which is engaged with and follows said liquid retentive roller and has a non-liquid retentive layer on the surface thereof.

9. An apparatus in accordance with claim 3, wherein said liquid retentive roller is pivotally supported at such a position that a lower part of said roller is soaked in the processing solution stored in said process tank.

10. An apparatus in accordance with claim 1, further comprising: a temperature control unit for controlling the temperature of the processing solution, which is held on the surface of said liquid retentive roller and applied onto the photosensitive material, to a range suitable for processing.

11. An apparatus in accordance with claim 3, further comprising:

a chamber formed at the bottom of said process tank along the width thereof to connect to said process tank; and temperature control means arranged inside said chamber for controlling the temperature of said processing solution.

12. An apparatus in accordance with claim 11, wherein said formed on the bottom of said process tank has a valve for discharging processing solution stored in said process tank.

13. A method for processing a silver salt photosensitive material such as printing paper or photosensitive paper or film for direct plate making, comprising the steps of:

conveying said photosensitive material pressed against a liquid retentive roller, which holds processing solution on the surface thereof and rotates in the conveying direction of said photosensitive material; and supplying new or unused processing solution onto the surface of said liquid retentive roller prior to each press of said photosensitive material against said liquid retentive roller.

* * * * *